US006684654B2

(12) United States Patent
Fukasaku et al.

(10) Patent No.: US 6,684,654 B2
(45) Date of Patent: Feb. 3, 2004

(54) CONTROL VALVE FOR VARIABLE DISPLACEMENT COMPRESSOR

(75) Inventors: Hiroshi Fukasaku, Kariya (JP); Hirohito Hayashi, Kariya (JP); Kitaru Iwata, Kariya (JP); Satoshi Umemura, Kariya (JP); Ryo Matsubara, Kariya (JP); Taku Adaniya, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 1 day.

(21) Appl. No.: 10/143,357

(22) Filed: May 9, 2002

(65) Prior Publication Data

US 2003/0014990 A1 Jan. 23, 2003

(30) Foreign Application Priority Data

May 10, 2001 (JP) ..... 2001-140244

(51) Int. Cl.[7] ..... F25B 1/00; F25B 49/00

(52) U.S. Cl. ..... 62/228.3; 251/129.15; 310/15; 417/222.2

(58) Field of Search ..... 62/228.3, 228.5; 417/222.2; 251/30.01, 129.15

(56) References Cited

U.S. PATENT DOCUMENTS 5,685,519 A * 11/1997 Bircann et al. ..... 219/129.15
6,439,213 B2 * 8/2002 Bircann et al. ..... 123/568.21
2001/0002237 A1 5/2001 Ota et al. ..... 417/222.2

FOREIGN PATENT DOCUMENTS

EP 1 074 800 A2 2/2001 ..... F25B/49/02

* cited by examiner

*Primary Examiner*—William Wayner
(74) *Attorney, Agent, or Firm*—Morgan & Finnegan, LLP

(57) ABSTRACT

A control valve includes an accommodation cylinder, a coil, a stator, a plunger, and a valve body. Electromagnetic force is generated between the stator and the plunger and the plunger moves relative to the stator. The valve body adjusts the opening degree of a valve hole. A flat surface and a peripheral wall are formed in an end of the stator. The peripheral wall has a tapered cross-section with an inclined inner surface. The inclined inner surface and the flat surface define a recess. The plunger has a frustum portion. The frustum portion includes a flat distal surface and an annular inclined surface. The taper angle of the peripheral wall is equal to or less than twenty degrees. The diameter of the flat distal surface of the frustum portion is equal to or greater than eighty percent of the largest diameter of the annular inclined surface.

11 Claims, 7 Drawing Sheets

Fig.6(a)

Maximum Electromagnetic Force

| Taper Angle θ (°) \ r/R×100 (%) | 76 | 78 | 80 | 82 | 84 | 86 |
|---|---|---|---|---|---|---|
| 14 | × | × | ○ | ○ | ○ | ○ |
| 15 | × | × | ○ | ○ | ○ | ○ |
| 16 | × | × | ○ | ○ | ○ | ○ |
| 17 | × | × | ○ | ○ | ○ | ○ |
| 18 | × | × | ○ | ○ | ○ | ○ |
| 19 | × | × | ○ | ○ | ○ | ○ |
| 20 | × | × | ○ | ○ | ○ | ○ |
| 21 | × | × | ○ | ○ | ○ | ○ |
| 22 | × | × | ○ | ○ | ○ | ○ |
| 23 | × | × | ○ | ○ | ○ | ○ |
| 24 | × | ○ | ○ | ○ | ○ | ○ |
| 25 | × | ○ | ○ | ○ | ○ | ○ |

Fig.6(b)

Rate of Change of Electromagnetic Force at Minimum Duty Ratio

| Taper Angle θ (°) \ r/R×100 (%) | 76 | 78 | 80 | 82 | 84 | 86 |
|---|---|---|---|---|---|---|
| 14 | ○ | ○ | ○ | ○ | ○ | ○ |
| 15 | ○ | ○ | ○ | ○ | ○ | ○ |
| 16 | ○ | ○ | ○ | ○ | ○ | ○ |
| 17 | ○ | ○ | ○ | ○ | ○ | ○ |
| 18 | ○ | ○ | ○ | ○ | ○ | ○ |
| 19 | ○ | ○ | ○ | ○ | ○ | ○ |
| 20 | ○ | ○ | ○ | ○ | ○ | ○ |
| 21 | ○ | ○ | × | × | × | × |
| 22 | ○ | × | × | × | × | × |
| 23 | × | × | × | × | × | × |
| 24 | × | × | × | × | × | × |
| 25 | × | × | × | × | × | × |

Fig.6(c)

Final Determination

| Taper Angle θ (°) \ r/R×100 (%) | 76 | 78 | 80 | 82 | 84 | 86 |
|---|---|---|---|---|---|---|
| 14 | × | × | ○ | ○ | ○ | ○ |
| 15 | × | × | ○ | ○ | ○ | ○ |
| 16 | × | × | ○ | ○ | ○ | ○ |
| 17 | × | × | ○ | ○ | ○ | ○ |
| 18 | × | × | ○ | ○ | ○ | ○ |
| 19 | × | × | ○ | ○ | ○ | ○ |
| 20 | × | × | ○ | ○ | ○ | ○ |
| 21 | × | × | × | × | × | × |
| 22 | × | × | × | × | × | × |
| 23 | × | × | × | × | × | × |
| 24 | × | × | × | × | × | × |
| 25 | × | × | × | × | × | × |

CONTROL VALVE FOR VARIABLE DISPLACEMENT COMPRESSOR

BACKGROUND OF THE INVENTION

The present invention relates to a control valve for controlling the displacement of a variable displacement compressor in a refrigerant circuit of an air conditioner.

One type of such control valve includes a pressure sensing mechanism and an electromagnetic actuator. The pressure sensing mechanism detects the pressure at a pressure monitoring point located in the refrigerant circuit. A pressure sensing member is actuated based on changes of the pressure at the pressure monitoring point. Accordingly, a valve body is moved such that the displacement of the variable displacement compressor is changed to counteract the pressure changes. As a result, the pressure at the pressure monitoring point is maintained at a target level. The electromagnetic actuator changes the target level by changing electromagnetic force applied to the valve body in accordance with the level of electric current supplied from the outside.

FIG. 8 illustrates the structure of such an electromagnetic actuator 101. The electromagnetic actuator 101 includes an accommodation cylinder 102. A stator 103 and a plunger 104 are accommodated in the cylinder 102. A coil 105 is located about the cylinder 102. As electric current is supplied to the coil 105, electromagnetic force is generated between the stator 103 and the plunger 104. This moves the plunger 104. The movement of the plunger 104 is transmitted to a valve body (not shown) by a rod 106.

A flat inner surface 107 and a peripheral wall 108 are formed in the lower end of the stator 103, which faces the plunger 104. The inner circumferential surface of the peripheral wall 108 is referred to as an inclined surface 108*a*. The inner surface 107 is surrounded by the inclined surface 108*a*. The cross-section of the peripheral wall 108 defines an acute angle. The inner surface 107 and the peripheral wall 108 define a recess 109. A flat distal surface 110 and an annular inclined surface 111 are formed in an upper end of the plunger 104, which faces the plunger 104. The inclined surface 111 is formed at the periphery of the distal surface 110. The distal surface 110 and the inclined surface 111 define a frustum portion 112.

When the coil 105 receives a low electric current, the position of the valve body, which is coupled to the plunger 104, is unstable (this state will be described in the preferred embodiment section). This fluctuates the electromagnetic force as the distance between the plunger 104 and the stator 103 changes. The structure shown in FIG. 8 suppresses thus fluctuation. The structure also increases the maximum level of the electromagnetic force applied to the valve body by the electromagnetic actuator 101.

For example, suppose the stator 103 has a triangular cross-section and the plunger 104 is formed as a cone the shape of which corresponds to the stator 103 as schematically shown in FIG. 9(*a*). This structure suppresses changes of the shortest distance between the stator 103 and the plunger 104 when the plunger 104 is moved.

Therefore, as shown in the graph of FIG. 9(*b*), the electromagnetic force applied to the valve body by the actuator 101 is relatively gradually changed by changes of the position of the plunger 104. This stabilizes the position of the valve body when the coil 105 receives a low current. The shapes of the plunger 104 and the stator 103 in FIG. 8 are determined to obtain the effect of the structure shown in FIG. 9(*a*). Specifically, the frustum portion 112 (having the inclined surface 111) and the recess 109 (having the inclined surface 108*a*) face each other.

Also, suppose the entire lower surface of the stator 103 and the entire upper surface of the plunger 104 are flat as schematically shown in FIG. 10(*a*). In this structure, the magnetic flux is increased when the plunger 104 approaches the stator 103.

Therefore, as shown in the graph of FIG. 10(*b*), the maximum value of the electromagnetic force applied to the valve body by the actuator 101 is increased. This permits a target pressure level, which is used as a reference in the operation of the pressure sensing mechanism, to be set to a higher level. In other words, a certain level of the target pressure can be set by a smaller actuator 101. This reduces the size of the control valve. The shapes of the plunger 104 and the stator 103 in FIG. 8 are determined to obtain the effect of the structure shown in FIG. 10(*a*). Specifically, the frustum portion 112 having the flat distal surface 110 and the recess 109 having the flat inner surface 107 face each other.

However, in the prior art, the sizes and the shapes of the recess 109 of the stator 103 and the frustum portion 112 of the plunger 104 are not optimized. Thus, a sufficient effect cannot be obtained.

SUMMARY OF THE INVENTION

Accordingly, it is an objective of the present invention to provide a control valve for a variable displacement compressor that optimizes the shapes of parts of a plunger and a stator that face each other.

To achieve the foregoing and other objectives and in accordance with the purpose of the present invention, a control valve for changing the displacement of a compressor is provided. The control valve includes an accommodation cylinder, a coil located about the accommodation cylinder, a stator located in the accommodation cylinder, a plunger located in the accommodation cylinder, and a valve body coupled to the plunger. When electric current is supplied to the coil, electromagnetic force is generated between the stator and the plunger and the plunger moves relative to the stator in the accommodation cylinder, accordingly. When the plunger moves, the valve body moves accordingly and adjusts the opening degree of a valve hole. A flat surface and a peripheral wall surrounding the flat surface are formed in an end of one of the plunger and the stator that faces the other one of the plunger and the stator. The peripheral wall has a tapered cross-section with an inclined inner surface. The inclined inner surface and the flat surface define a recess. A frustum portion is formed in an end of the other one of the plunger and the stator that faces the recess. The frustum portion includes a flat distal surface and an annular inclined surface. The taper angle of the peripheral wall is equal to or less than twenty degrees. The diameter of the flat distal surface of the frustum portion is equal to or greater than eighty percent of the largest diameter of the annular inclined surface.

The present invention may also be applied to a compressor used in a refrigerant circuit of an air conditioner. The compressor includes a control chamber, a bleed passage, a supply passage, and a control valve. The compressor displacement is changed by adjusting the pressure in the control chamber. The bleed passage connects the control chamber to a suction pressure zone of the refrigerant circuit. The supply passage connects a discharge pressure zone of the refrigerant circuit to the control chamber. The control valve changes the displacement of a compressor. The control valve includes an accommodation cylinder, a coil located about the accommodation cylinder, a stator located in the accommodation cylinder, a plunger located in the accommodation cylinder, and a valve body coupled to the plunger. When electric current is supplied to the coil, electromagnetic force is generated between the stator and the plunger and the plunger moves relative to the stator in the accommodation cylinder, accordingly. When the plunger moves, the valve body moves accordingly and adjusts the opening degree of a valve hole. A flat surface and a peripheral wall surrounding the flat surface are formed in an end of one of the plunger and the stator that faces the other one of the plunger and the stator. The peripheral wall has a tapered cross-section with an inclined inner surface. The inclined inner surface and the flat surface define a recess. A frustum portion is formed in an end of the other one of the plunger and the stator that faces the recess. The frustum portion includes a flat distal surface and an annular inclined surface. The taper angle of the peripheral wall is equal to or less than twenty degrees. The diameter of the flat distal surface of the frustum portion is equal to or greater than eighty percent of the largest diameter of the annular inclined surface.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 6(*a*) is a chart for obtaining the maximum magnetic force of the control valve shown in FIG. 2;

FIG. 6(*b*) is a chart for obtaining the rate of change of the magnetic force in relation to the opening degree;

FIG. 6(*c*) is a chart for obtaining the optimal configuration of the characteristics of the control valve shown in FIG. 2;

FIG. 9(*b*) is a graph for explaining the characteristics of the prior art control valve;

FIG. 10(*b*) is a graph for explaining the characteristics of the prior art control valve.

DETAILED DESCRIPTION OF THE PREFERRED EMBODIMENTS

A control valve CV according to a first embodiment of the present invention will now be described. The control valve CV is used in a variable displacement swash plate type compressor for a refrigerant circuit of a vehicular air conditioner.

Figure 1:
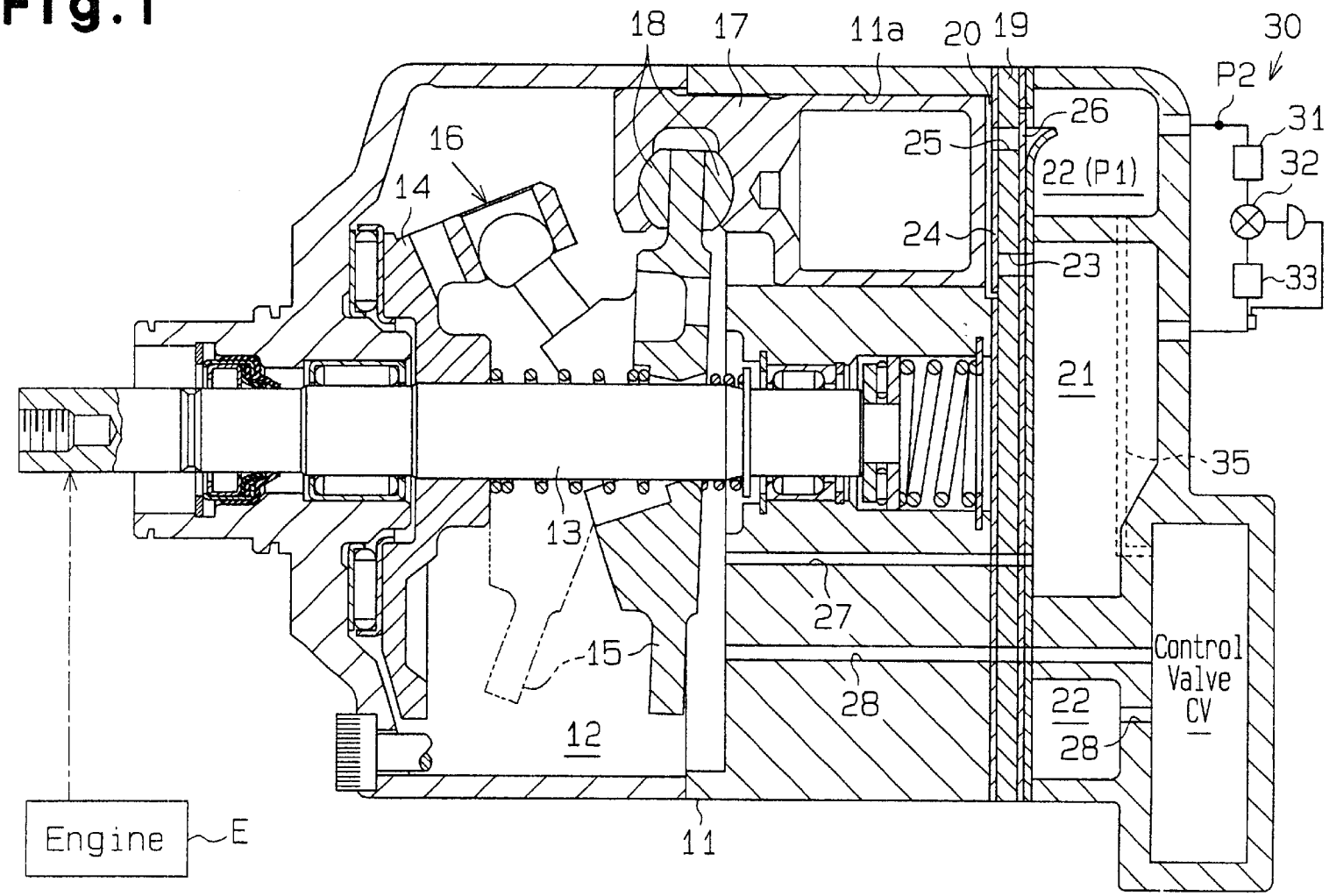
FIG. 1 is a cross-sectional view illustrating a variable displacement swash plate type compressor according to a first embodiment of the present invention.

As shown in FIG. 1, the compressor includes a housing 11. A control chamber, which is a crank chamber 12 in this embodiment, is defined in the housing 11. A drive shaft 13 is rotatably provided in the crank chamber 12. The drive shaft 13 is coupled to an engine E, which is drive source of the vehicle and rotated by force supplied by the engine E.

A lug plate 14 is located in the crank chamber 12 and is secured to the drive shaft 13 to integrally rotate with the drive shaft 13. A cam plate, which is a swash plate 15 in this embodiment, is located in the crank chamber 12. The swash plate 15 is tiltably and slidably supported by the drive shaft 13. A hinge mechanism 16 is located between the lug plate 14 and the swash plate 15. The hinge mechanism 16 permits the swash plate 15 to integrally rotate with the lug plate 14 and the drive shaft 13 and to tilt with respect to the drive shaft 13.

Cylinder bores 11*a* (only one is shown in the drawing) are formed in the housing. A single-headed piston 17 is reciprocally accommodated in each cylinder bore 11*a*. Each piston 17 is coupled to the peripheral portion of the swash plate 15 by a pair of shoes 18. As the swash plate 15 is rotated by rotation of the drive shaft 13, the shoes 18 convert the rotation into reciprocation of the pistons 17.

A valve plate assembly 19 is located at the rear end (right end as viewed in the drawing) of the cylinder bores 11*a*. A compression chamber 20 is defined in each cylinder bore 11*a* by the associated piston 17 and the valve plate assembly 19. A suction chamber 21 and a discharge chamber 22 are defined in the housing 11 at the rear side of the valve plate assembly 19. The suction chamber 21 forms part of a suction pressure zone, and the discharge chamber 22 forms part of a discharge pressure zone.

Sets of suction port 23 and discharge port 25 are formed in the valve plate assembly 19. Suction valve flaps 24 and discharge valve flaps 26 are formed on the valve plate assembly 19. Each suction valve flap 24 corresponds to one of the suction ports 23, and each discharge valve flap 26 corresponds to one of the discharge port 25. Each set of ports 23, 25 corresponds to one of the cylinder bores 11*a*.

As each piston 17 is moved from the top dead center position to the bottom dead center position, refrigerant gas is drawn into the associated compression chamber 20 from the suction chamber 21 through the corresponding suction port 23 and the corresponding suction valve flap 24. Then, as the piston 17 is moved from the bottom dead center to the top dead center, the refrigerant gas is compressed to a predetermined pressure level and is discharged to the discharge chamber 22 through the corresponding discharge port 25 and the corresponding discharge valve flap 26.

A bleed passage 27 and a supply passage 28 are formed in the housing 11. The bleed passage 27 connects the crank chamber 12 with the suction chamber 21. The supply passage 28 connects the discharge chamber 22 with the crank chamber 12. The control valve CV is located in the supply passage 28.

The opening degree of the control valve CV is adjusted to control the flow rate of highly pressurized gas supplied to the crank chamber 12 through the supply passage 28. The pressure in the crank chamber 12 is determined by the ratio of the flow rate of gas supplied to the crank chamber 12 through the supply passage 28 and the flow rate of refrigerant gas conducted out from the crank chamber 12 through the bleed passage 27. As the crank chamber pressure varies, the difference between the crank chamber pressure and the pressure in the compression chambers 20 with the pistons 17 in between varies, which changes the inclination angle of the swash plate 15. Accordingly, the stroke of each piston 17, or the compressor displacement, is varied.

When the crank chamber pressure is lowered, the inclination angle of the swash plate 15 is increased and the compressor displacement is increased. Broken line in FIG. 1 shows the maximum inclination position of the swash plate 15. The swash plate 15 is prevented from being further inclined by the lug plate 14. When the crank chamber pressure is increased, the inclination angle of the swash plate 15 is decreased, and the compressor displacement is decreased, accordingly. Solid line in FIG. 1 shows the minimum inclination angle position of the swash plate 15.

As shown in FIG. 1, the refrigerant circuit includes the compressor and an external refrigerant circuit 30. The external circuit 30 includes a condenser 31, an expansion valve 32, and an evaporator 33. Carbon dioxide is used as the refrigerant.

A first pressure monitoring point P1 is located in the discharge chamber 22. A second pressure monitoring point P2 is located in a pipe connecting the discharge chamber 22 with the condenser 31. The pressure at the first pressure monitoring point P1 is referred to as PdH. The pressure at the second pressure monitoring point P2 is referred to as PdL. The difference between the pressure PdH and the pressure PdL is referred to as ΔPd. The second pressure monitoring point P2 is spaced from the first pressure monitoring point P1 toward the condenser 31, or in the downstream direction. The first pressure monitoring point P1 is connected to the control valve CV by a first pressure introducing passage 35. The second pressure monitoring point P2 is connected to the control valve CV by a second pressure introducing passage 36 (see FIG. 2).

Figure 2:
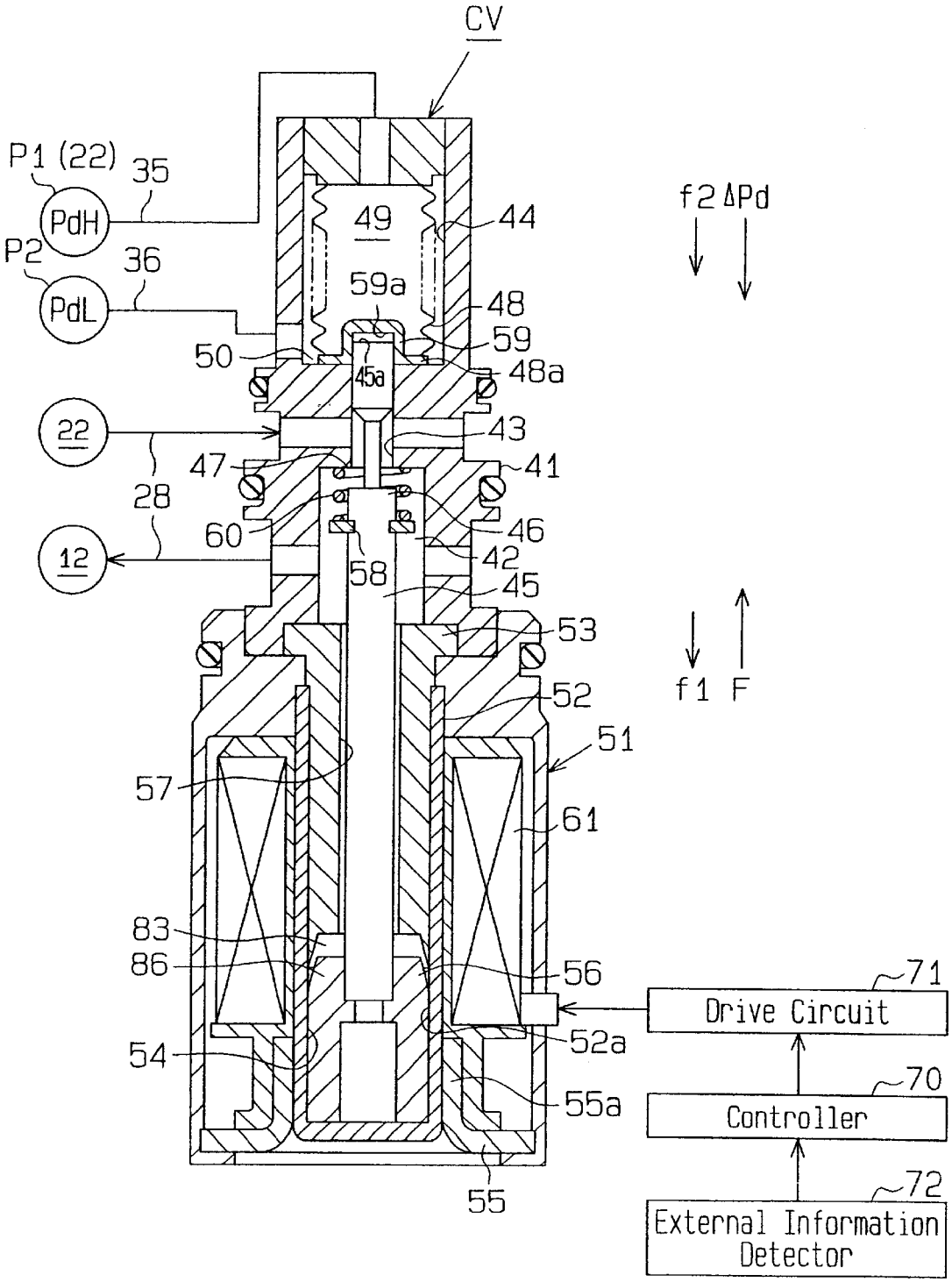
FIG. 2 is a cross-sectional view illustrating the control valve used in the compressor shown in FIG. 1.

As shown in FIG. 2, the control valve CV includes a valve housing 41. A valve chamber 42, a communication passage 43, and a pressure sensing chamber 44 are defined in the valve housing 41. A transmission rod 45 extends through the valve chamber 42 and the communication passage 43. The transmission rod 45 moves in the axial direction, or in the vertical direction as viewed in the drawing. The rod 45 includes an upper block and a lower block coupled to each other by a thin portion. The thin portion is slidably fitted in the communication passage 43. The transmission rod 45 functions as a valve body. The communication passage 43 is disconnected from the pressure sensing chamber 44 by the upper block of the transmission rod 45. The valve chamber 42 is connected to the crank chamber 12 through a downstream section of the supply passage 28. The communication passage 43 is connected to the discharge chamber 22 through an upstream section of the supply passage 28. The valve chamber 42 and the communication passage 43 form a part of the supply passage 28.

The upper end portion of the lower block of the transmission rod 45 functions as an opening adjuster 46, which is located in the valve chamber 42. A step defined between the valve chamber 42 and the communication passage 43 functions as a valve seat 47. The communication passage 43 functions as a valve hole. When the transmission rod 45 is moved from the position of FIGS. 2 and 3(*a*), or the lowermost position, to the position of FIG. 3(*c*), or the uppermost position, at which opening adjuster 46 contacts the valve seat 47, the communication passage 43 is disconnected from the valve chamber 42. That is, opening adjuster 46 controls the opening degree of the supply passage 28.

A pressure sensing member, which is a bellows 48 in this embodiment, is located in the pressure sensing chamber 44. The upper end of the bellows 48 is fixed to the valve housing 41. A rod receiving recess 59 is formed in a movable lower end portion 48*a* of the bellows 48. Part of the upper block of the transmission rod 45 is loosely fitted in the rod receiving recess 59. The pressure sensing chamber 44 and the bellows 48 form a pressure sensing mechanism.

The pressure sensing chamber 44 is divided into a first pressure chamber 49, which is the interior of the bellows 48, and a second pressure chamber 50, which is the exterior of the bellows 48. The first pressure chamber 49 is exposed to the pressure PdH at the first pressure monitoring point P1 through the first pressure introducing passage 35. The second pressure chamber 50 is exposed to the pressure PdL at the second pressure monitoring point P2 through the second pressure introducing passage 36.

The movement of the lower end portion 48*a* of the bellows 48 toward the transmission rod 45 is limited by contact between the lower end portion 48*a* and the bottom of the second pressure chamber 50. In other words, the bottom of the second pressure chamber 50 functions as a pressure sensing member stopper. The elasticity of the bellows 48 urges the lower end portion 48*a* toward the bottom of the second pressure chamber 50. The force of the bellows 48 is a valve opening force based on its own elasticity and is referred to as f2.

An electromagnetic actuator 51 is located below the valve housing 41. A cup shaped accommodation cylinder 52 is located in the radial center of the actuator 51. A cylindrical stator 53 is press fitted to the upper opening of the accommodation cylinder 52. The stator 53 is made of a magnetic material such as an iron-based material. The stator 53 defines a plunger chamber 54 in the lowest portion of the accommodation cylinder 52.

An annular plate 55 made of a magnetic material is attached to the lower end of the actuator 51 from the lower opening. The plate 55 has a central hole and includes a cylindrical portion 55*a*, which protrudes upward from the periphery of the central hole. The plate 55 is attached to the actuator 51 by fitting the cylindrical portion 55*a* about the accommodation cylinder 52 and fills an annular space about the accommodation cylinder 52.

An inverted cup-shaped plunger 56 is accommodated in the plunger chamber 54. The plunger 56 is made of a magnetic material and moves in the axial direction. Movement of the plunger 56 is guided by the inner surface 52*a* of the accommodation cylinder 52. An axial guide hole 57 is formed in the central portion of the stator 53. The lower portion of the transmission rod 45 is movably located in the guide hole 57.

The lower end of the transmission rod 45 is fixed to the plunger 56 in the plunger chamber 54 so that the plunger 56 and the transmission rod 45 move integrally. Upward movement of the transmission rod 45 and the plunger 56 is limited by contact between opening adjuster 46 of the transmission rod 45 and the valve seat 47. When the transmission rod 45 and the plunger 56 are at the uppermost position, opening adjuster 46 fully closes the communication passage 43 (see FIG. 3(*c*)).

A spring seat 58 is fitted about the transmission rod 45 and is located in the valve chamber 42. A coil spring 60 extends between the spring seat 58 and part of the valve housing 41 that is adjacent to the valve seat 47. The coil spring 60 urges the opening adjuster 46 away from the valve seat 47. The spring constant of the coil spring 60 is significantly smaller than that of the bellows 48. The force f1 applied to the transmission rod 45 by the coil spring 60 is substantially constant regardless of the distance between opening adjuster 46 and the valve seat 47, or the compression state of the spring 60.

Figures 3A, 3B, 3C:
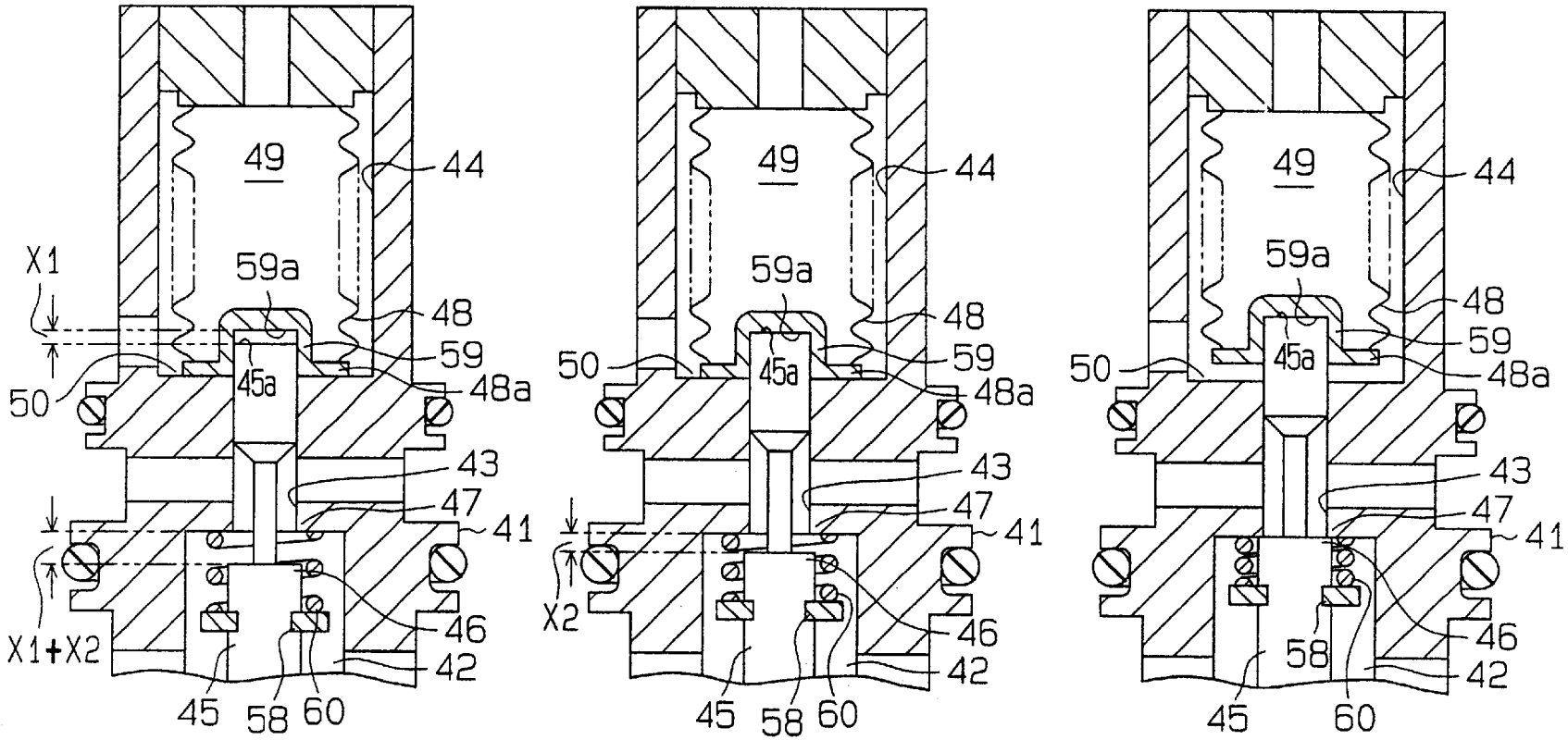
FIGS. 3(*a*), 3(*b*), 3(*c*) are cross-sectional views showing the operation of the control valve shown in FIG. 2.

As shown in FIGS. 2 and 3(*a*), the downward movement of the transmission rod 45 (the valve body) and the plunger 56 is limited by contact between the lower end surface of the plunger 56 and the bottom of the plunger chamber 54. The bottom of the plunger chamber 54 therefore functions as a valve body stopper. When the transmission rod 45 and the plunger 56 are at the lowest position, opening adjuster 46 is separated from the valve seat 47 by distance X1+X2, and the opening of the communication passage 43 is maximized. In this state, the rod receiving recess 59 of the bellows 48 contacts the bottom of the second pressure chamber 50, and the upper surface 45*a* of the transmission rod 45 is separated from the ceiling 59*a* of the rod receiving recess 59 by a distance X1.

A coil 61 is wound about the accommodation cylinder 52 to surround the stator 53 and the plunger 56. The coil 61 is connected to a drive circuit 71, and the drive circuit 71 is connected to a controller (computer) 70. The controller 70 is connected to an external information detector 72. The controller 70 receives external information (on-off state of the air conditioner, the temperature of the passenger compartment, and a target temperature) from the detector 72. Based on the received information, the controller 70 commands the drive circuit 71 to supply electric current to the coil 61.

The electric current from the drive circuit 71 generates magnetic flux in the coil 61. The flux flows to the plunger 56 through the plate 55 and the accommodation cylinder 52, and then flows from the plunger 56 to the coil 61 through the stator 53. Thus, an electromagnetic attraction force F, the magnitude of which corresponds to the level of the electric current supplied to the coil 61, is generated between the plunger 56 and the stator 53. The force F is transmitted to the transmission rod 45 by the plunger 56. The electric current supplied to the coil 61 is controlled by adjusting the applied voltage. In this embodiment, the applied voltage is controlled by pulse-width modulation.

The position of the transmission rod 45 (the valve body), or the opening degree of the control valve CV, is determined in the following manner.

FIGS. 2 and 3(*a*) show a state in which no current is supplied to the coil 61 (duty ratio=0%). In this state, the downward force f1 of the coil spring 60 is dominant in determining the position of the transmission rod 45. Therefore, the transmission rod 45 is located at the lowest position by the force f1 of the coil spring 60, and opening adjuster 46 is separated from the valve seat 47 by the distance X1+X2, which fully opens the communication passage 43.

Thus, the pressure in the crank chamber 12 is maximized under the given condition, which increases the difference between the crank chamber pressure and the pressure in the compression chambers 20 with the pistons 17 in between. As a result, the inclination angle of the swash plate 15 is minimized, and the displacement of the compressor is minimized.

When the transmission rod 45 is at the lowest position, the upper surface 45*a* of the transmission rod 45 is separated from the ceiling 59*a* of the rod receiving recess 59 by at least the distance X1. In this state, the position of the lower end portion 48*a* of the bellows 48 is chiefly determined by the downward force based on the pressure difference ΔPd (ΔPd=PdH−PdL) and the downward force f2 of the bellows 48. Therefore, the lower end portion 48*a* of the bellows 48 is pressed against the bottom of the second pressure chamber 50 by the resultant force. When the lower end portion 48*a* of the bellows 48 contacts the bottom of the second pressure chamber 50, the force f2 of the bellows 48 acting on the lower end of the 48*a* becomes substantially eliminated.

When the electric current corresponding to the minimum duty ratio within the duty ratio range is supplied to the coil 61, the upward electromagnetic force F exceeds the downward force f1 of the spring 60. Therefore, as shown in FIG. 3(*b*), the transmission rod 45 is moved upward from the lowest position by at least the distance X1 and contacts the ceiling of the rod receiving recess 59. In other words, the transmission rod 45 is engaged with the bellows 48.

When the transmission rod 45 is fully engaged with the bellows 48, the upward electromagnetic force F, which is weakened by the downward force f1 of the spring 60, opposes the force based on the pressure difference ΔPd, which is increased by the downward force f2 of the bellows 58. The position of opening adjuster 46 of the rod 45 relative to the valve seat 47 is determined such that the opposing forces are balanced. The effective opening degree of the control valve CV, controlled by the pressure difference ΔPd, is determined between the middle opened position of FIG. 3(*b*) and the fully closed position of FIG. 3(*c*).

For example, if the flow rate of the refrigerant in the refrigerant circuit is decreased due to a decrease in the speed of the engine E, the downward force based on the pressure difference ΔPd decreases. Thus, downward forces acting on the transmission rod 45 cannot counterbalance the upward electromagnetic force F. Therefore, the transmission rod 45 (the valve body) moves upward and decreases the opening degree of the communication passage 43. This lowers the pressure in the crank chamber 12. Accordingly, the inclination angle of the swash plate 15 is increased, and the compressor displacement is increased. As the compressor displacement is increased, the flow rate of refrigerant in the refrigerant circuit is increased, which increases the pressure difference ΔPd.

When the flow rate of the refrigerant in the refrigerant circuit is increased due to an increase in the speed of the engine E, the downward force based on the pressure difference ΔPd increases. Thus, the upward electromagnetic force F acting on the transmission rod 45 cannot counterbalance the downward forces. Therefore, the transmission rod 45 (the valve body) moves downward, which increases the opening degree of the communication passage 43. This increases the pressure in the crank chamber 12. Accordingly, the inclination angle of the swash plate 15 is decreased, and the compressor displacement is decreased. As the compressor displacement is decreased, the flow rate of refrigerant in the refrigerant circuit is decreased, and the pressure difference ΔPd is decreased.

When the duty ratio of the electric current supplied to the coil 61 is increased to increase the upward electromagnetic force F, the downward forces of the pressure difference ΔPd and the spring cannot counterbalance the upward force acting on the transmission rod 45. Therefore, the transmission rod 45 (the valve body) moves upward and decreases the opening degree of the communication passage 43. As a result, the displacement of the compressor is increased. Accordingly, the flow rate of the refrigerant in the refrigerant circuit is increased and the pressure difference ΔPd is increased.

When the duty ratio of the electric current supplied to the coil 61 is decreased and the electromagnetic force is decreased accordingly, the upward force acting on the transmission rod 45 cannot counterbalance the downward forces of pressure difference ΔPd and the spring. Therefore, the transmission rod 45 (the valve body) moves downward, which increases the opening degree of the communication passage 43. Accordingly, the compressor displacement is decreased. As a result, the flow rate of the refrigerant in the refrigerant circuit is decreased, and the pressure difference ΔPd is decreased.

As described above, the target value of the pressure difference ΔPd is determined by the duty ratio of current supplied to the coil 61. The control valve CV automatically determines the position of the transmission rod 45 (the valve body) according to changes of the pressure difference ΔPd to maintain the target value of the pressure difference ΔPd. The target value of the pressure difference ΔPd is externally controlled by adjusting the duty ratio of current supplied to the coil 61.

The electromagnetic actuator 51 of the control valve CV has the following characteristics.

Figure 4:
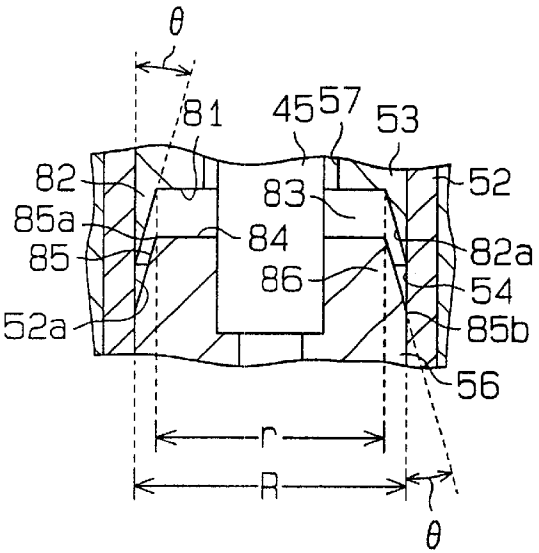
FIG. 4 is an enlarged partial cross-sectional view of the control valve shown in FIG. 2.

As shown in FIG. 4, a recess 83 is formed in the lower end portion of the stator 53, which faces the plunger 56. The recess 83 includes an annular flat surface 81 and a peripheral wall 82. The flat surface 81 is perpendicular to the axis of the valve housing 41. The peripheral wall 82 has a tapered cross-section with an inclined inner surface 82*a*. A frustum portion 86 is formed in the upper end portion of the plunger 56, which faces the stator 53. An annular distal surface 84, which is perpendicular to the axis of the valve housing 41, is formed at the upper end of the frustum portion 86. Also, an annular inclined surface 85 is formed at the periphery of the distal surface 84.

The diameter of the flat surface 81 of the recess 83 and the diameter of the distal surface 84 of the frustum portion 86 are the same and that diameter is referred to as a diameter r. The taper angle of the peripheral wall 82 of the recess 83 and the taper angle of the inclined surface 85 of the frustum portion 86 are the same and are referred to as a taper angle θ.

The taper angle θ is equal to or less than 20° (16° in this embodiment). The diameter r of the diameter of the distal surface 84 of the frustum portion 86 is equal to or is greater than 80% of the diameter R of the largest diameter portion 85*b* of the frustum portion 86. In other words, the ratio r/R is equal to or greater than 80% (84% in this embodiment).

The coil 61 generates the maximum electromagnetic force Fmax when receiving an electric current having the maximum duty ratio. The maximum electromagnetic force Fmax is greater than that of a comparison example shown by the top solid line and the top broken line (the taper angle θ=25°, r/R=77%). Thus, a greater value of the pressure difference ΔPd (the refrigerant flow rate) can be obtained without increasing the size of the actuator 51.

Figure 5:
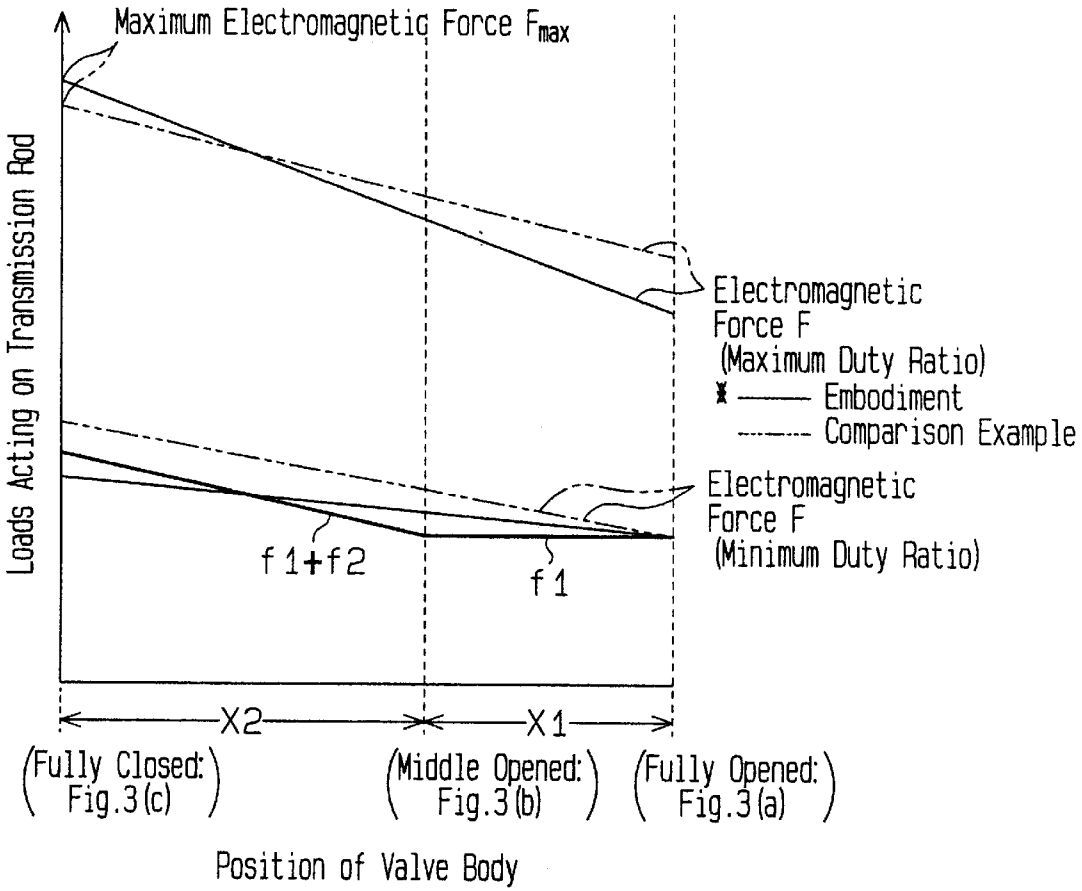
FIG. 5 is a graph showing loads acting on the transmission rod of the control valve shown in FIG. 2 in relation with the position of the rod and the duty ratio of current applied to the coil of the control valve.

When the coil 61 receives a current of the minimum duty ratio, the change in the electromagnetic force F due to changes of the distance between the plunger 56 and the stator 53, or the inclination of the electromagnetic force F, is less than that of the comparison example, which is shown by lower broken line in FIG. 5. Therefore, the characteristic line representing the electromagnetic force F (the minimum duty ratio) intersects the characteristic line representing the resultant f1+f2 of the spring forces at a midpoint between the fully closed position and the middle opened position. Thus, when the pressure difference ΔPd is zero, the position of opening adjuster 46 can be determined between the fully closed position and the middle opened position even if the coil 61 receives a current of the minimum duty ratio.

The electromagnetic force F of the comparison example is always greater than the resultant spring force f1+f2 in the range between the fully closed position and the middle open position. Therefore, if the coil 61 receives a current having a duty ratio that is equal to or greater than the minimum duty ratio when the pressure difference ΔPd is zero, opening adjuster 46 is moved to the fully closed position. If the compressor displacement is gradually increased from the state in which the pressures in the refrigerant circuit are equalized (ΔPd=0) by gradually increasing the duty ratio of the current supplied to the coil 61 from the minimum duty ratio, opening adjuster 46 is abruptly fully closes the communication passage 43. This abruptly and excessively increases the compressor displacement. As a result, the compressor torque acting on the engine E (the torque required for driving the compressor) is suddenly and excessively increased, which degrades the drivability of the vehicle.

The preferable ranges of the taper angle θ (0°<θ≦20°) and the ratio of r and R (80%≦r/R<100%) are obtained in the following manner.

FIG. 6(*a*) is a chart of experiment results showing whether the maximum electromagnetic force Fmax generated by the actuator 51 is equal to or greater than a predetermined level in various combinations of the taper angle θ and the ratio r/R. In the chart of FIG. 6(*a*), the taper angle θ increments by one degree from 14° to 25°, and the ratio r/R increments by two percent from 76% to 86%. Each sign ○ represents that the maximum electromagnetic force Fmax is equal to or more than the predetermined level in the corresponding combination. Each sign × represents that the maximum electromagnetic force Fmax cannot exceed the predetermined level at the corresponding combination. As obvious from the chart, as the ratio r/R increases, or as the area of the flat surface 81 of the recess 83 and the area of the distal surface 84 are increased, the electromagnetic force Fmax is increased. Particularly, in combinations in which the ratio r/R is equal to or greater than 80%, all the combinations have the sign ○.

FIG. 6(*b*) is a chart of experiment results showing whether the rate of change of the electromagnetic force F in relation to the valve opening degree is equal to or less than a predetermined level when the coil 61 receives an electric current of the minimum duty ratio. The increments of the taper angle θ and the ratio r/R×100 are the same as those of FIG. 6(*a*). Each sign ○ represents that the rate of change of the electromagnetic force F is equal to or less than the predetermined level, or the force F changes gradually, at the corresponding combination. Each sign × represents that the rate of change of the electromagnetic force F exceeds the predetermined level. As obvious from the chart of FIG. 6(*b*), the rate of change of the electromagnetic force F is gradual when the taper angle θ is small. Particularly, in the combinations in which the taper angle θ is equal to or less than 20°, all the combinations have the sign ○.

Thus, a range that satisfies the preferable ranges of FIGS. 6(*a*) and 6(*b*) is when the taper angle θ is less than or equal to 20° and the ratio of r and R is greater than or equal to 80%, as shown in the final determination chart of FIG. 6(*c*).

Considering the above described characteristics, it is easily predicted that some combinations in ranges that are not described in FIG. 6(*c*) (a situation in which θ is between 0° and 14° and r/R is from 80% to 86%, and a situation in which θ is between 14° and 20° and r/R is between 86%< and 100%) are judged to have the sign ○. However, in these situations, the peripheral wall 82 is either both too long and too thin or it is too short. If the peripheral wall 82 is too long and thin, the strength is degraded. If the peripheral wall 82 is too short, the wall 82 is difficult to machine. Therefore, the ideal range of the taper angle θ is from 14° to 20° and ideal range of the ratio r/R θ is from 80% to 86%.

The above illustrated embodiment has the following advantages.

(1) As described above, the pressure difference ΔPd (the flow rate of refrigerant) can be set relatively great without increasing the size of the actuator 51, or the size of the control valve CV. At the same time, the operational characteristics of the control valve CV are stable when the coil 61 receives an electric current of a low duty ratio.

(2) The flat surface 81 of the recess 83 and the distal surface 83 of the frustum portion 86 have the same diameter r. The angle of the peripheral wall 82 of the recess 83 and the angle defined by the inclined surface 85 of the frustum portion 86 and the inner surface 52*a* of the accommodation cylinder 52 are the same angle θ. Therefore, the shape of the recess 83 coincides with the shape of the frustum portion 86, which increases the maximum electromagnetic force Fmax. Further, even if the angle of the peripheral wall 82 of the recess 83 is different from the angle of the inclined surface 85 by ±1°, the advantage (1) will still be obtained.

(3) The control valve CV adjusts the opening degree of the supply passage 28 to control the displacement of the compressor. The valve chamber 42 of the control valve CV is connected to the discharge chamber 22 by the communication passage 43, which is regulated by opening adjuster 46, and the upstream section of the supply passage 28. Therefore, the pressure difference between the communication passage 43 and the second pressure chamber 50, which is located adjacent to the communication passage 43, is lowered. This prevents gas from flowing between the chambers 43 and 50. Accordingly, the compressor displacement is accurately controlled.

However, the high pressure (discharge pressure) of the communication passage 43 acts on opening adjuster 46 in the direction opposing the valve opening direction, or in the direction opposing the electromagnetic force F, which decreases the load applied to the bellows 48 by the actuator 51. Since carbon dioxide is used as refrigerant in the illustrated embodiment, the discharge pressure, or the pressure in the communication passage 43, tends to be higher than that of a case where chlorofluorocarbon is used as refrigerant. Since the maximum electromagnetic force Fmax is increased without increasing the size, the control valve CV is particularly advantageous in permitting the pressure difference ΔPd (the refrigerant flow rate) to be set greater in a circuit using carbon dioxide.

(4) The spring 60 applies force f1, which acts against the electromagnetic force F, to the transmission rod 45. The spring 60 is located outside of the plunger chamber 54 (in the valve chamber 42 in the illustrated embodiment). Therefore, compared to a case where the spring 60 is located in the plunger chamber 54 (for example, an embodiment shown in FIG. 7), the above illustrated embodiment adds to the flexibility of the design of the plunger 56 to increase the areas of the surfaces 81, 84 on the plunger 56 and the stator 53, which face each other. The maximum electromagnetic force Fmax can be increased accordingly to promote the advantage (1).

Figure 7:
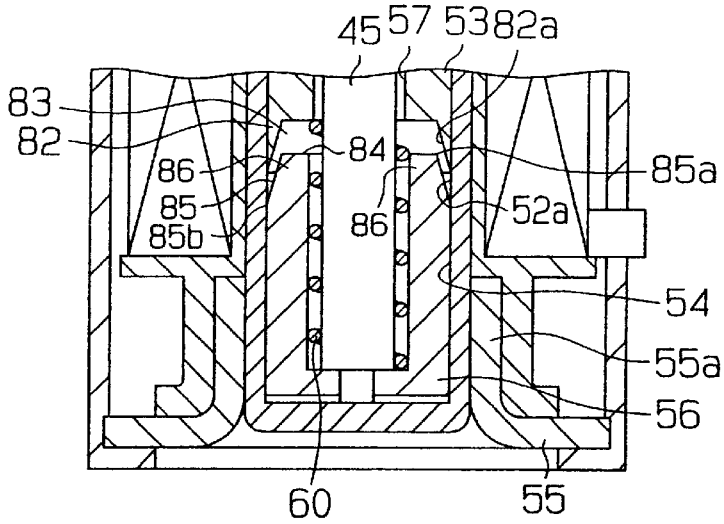
FIG. 7 is an enlarged partial cross-sectional view illustrating a control valve according to a second embodiment of the present invention.
Figure 8:
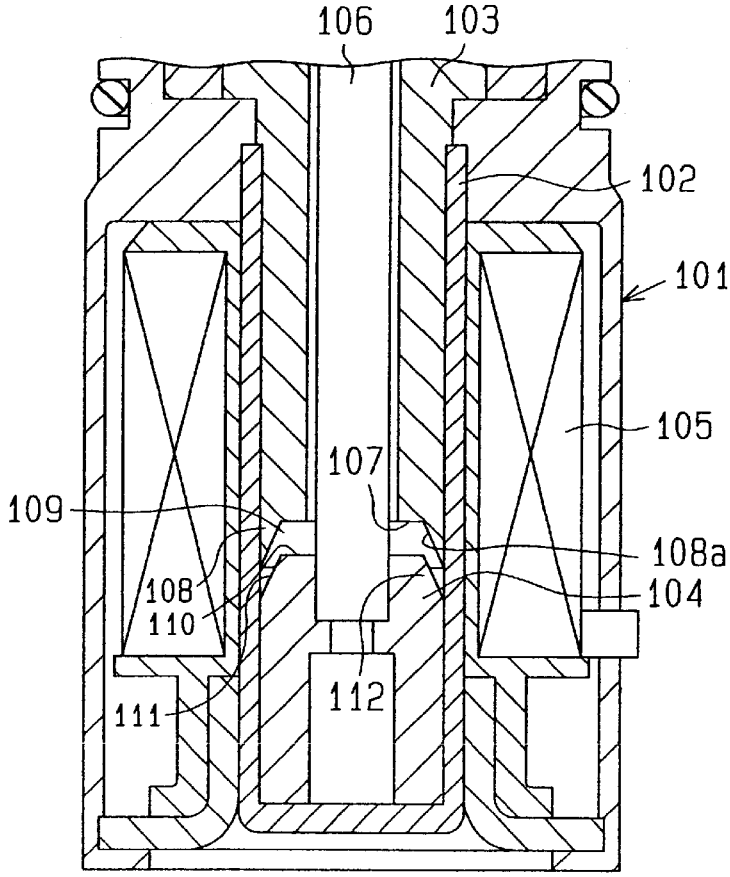
Fig.8(Prior Art)
FIG. 8 is an enlarged partial cross-sectional view illustrating a prior art control valve.
Figure 9A:
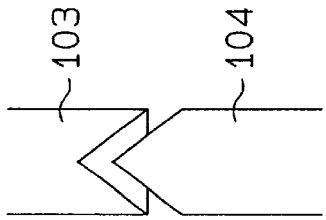
Fig.9(a)(Prior Art)
FIG. 9(*a*) a schematic view for explaining the characteristics of the prior art control valve.
Figure 9B:
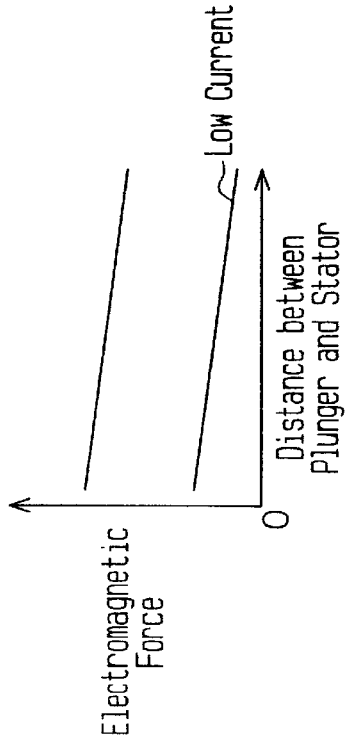
Fig.9(b)(Prior Art)
Figure 10A:
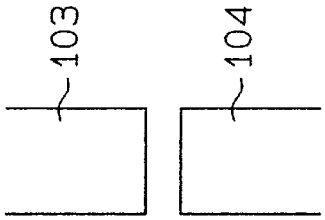
Fig.10(a)(Prior Art)
FIG. 10(*a*) a schematic view for explaining the characteristics of the prior art control valve.
Figure 10B:
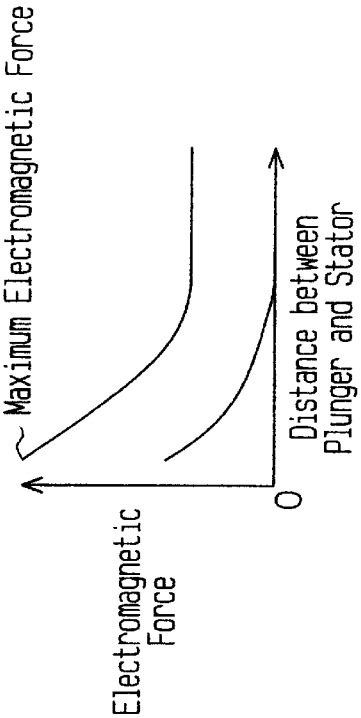
Fig.10(b)(Prior Art)

FIG. 7 shows a control valve CV according to the second embodiment.

As shown in FIG. 7, the control valve CV of the second embodiment is different from the control valve CV of the first embodiment in the position of the coil spring 60. In the second embodiment, the coil spring 60 is not located in the valve chamber 42 but in the plunger chamber 54. Specifically, the spring 60 extends between the stator 53 and the plunger 56 to apply a force f1 to the plunger 56 in the valve opening direction, or in the direction opposing to the electromagnetic force F. The plunger 56 is cylindrical with its closed end located at the bottom. The spring 60 is located in the cylinder. The control valve CV of the second embodiment has the advantages (1) to (3) of the control valve CV of the first embodiment.

It should be apparent to those skilled in the art that the present invention may be embodied in many other specific forms without departing from the spirit or scope of the invention. Particularly, it should be understood that the invention may be embodied in the following forms.

The recess 83 may be formed in the plunger 56 and the frustum portion 86 may be formed in the stator 53. That is, the shapes of the plunger 56 and the stator 53 may be reversed from those of the illustrated embodiments.

The first pressure monitoring point P1 may be located in the suction pressure zone, which includes the evaporator 33 and the suction chamber 21, and the second pressure monitoring point P2 may be located in the suction pressure zone at a position that is downstream of the first pressure monitoring point P1.

The first pressure monitoring point P1 may be located in the discharge pressure zone, which includes the discharge chamber 22 and the condenser 31, and the second pressure monitoring point P2 may be located in the suction pressure zone, which includes the evaporator 33 and the suction chamber 21.

In the illustrated embodiments, the pressure monitoring points P1, P2 are located in the main circuit of the refrigerant circuit, i.e., the evaporator 33, the suction chamber 21, the cylinder bores 11*a*, the discharge chamber 22, and the condenser 31. That is, the pressure monitoring points P1 and P2 are in a high pressure zone or a low pressure zone of the refrigerant circuit. However, the locations of the pressure monitoring points P1, P2 are not limited to those described in the illustrated embodiments. For example, the pressure monitoring points P1, P2 may be located in the crank chamber 12, which is an intermediate pressure zone of a subcircuit for controlling the displacement, or a circuit including the supply passage 28, the crank chamber 12, and the bleed passage 27.

The first pressure monitoring point P1 may be located in the discharge pressure zone, which includes the discharge chamber 22 and the condenser 31, and the second pressure monitoring point P2 may be located in the crank chamber 12.

In the pressure sensing chamber 44, the interior of the bellows 48 may be used as the second pressure chamber 50 and the exterior of the bellows 48 may be used as the first pressure chamber 49. In this case, the first pressure monitoring point P1 is located in the crank chamber 12, and the second pressure monitoring point P2 is located in the suction pressure zone between the evaporator 33 and the suction chamber 21.

The pressure sensing mechanism of the control valve CV may be actuated by the suction pressure or the discharge pressure. Specifically, in the illustrated embodiments, only the first pressure monitoring point P1 may be used, and the second pressure chamber 50 may be vacuum or exposed to the atmospheric pressure.

The present invention may be applied to an electromagnetic control valve that includes no pressure sensing mechanism.

The present invention may be applied to a bleed control valve, which controls the pressure in the crank chamber 12 by controlling the opening degree of the bleed passage 27.

The present invention may be applied to a control valve that adjusts the opening degrees of both of the bleed passage 27 and the supply passage 28 for controlling the pressure in the crank chamber 12. In this case, the bleed passage 27 and the supply passage 28 may be independent from each other like those in the illustrated embodiments. Alternatively, the bleed passage 27 and the supply passage 28 may have a common section between the control valve and the crank chamber 12. If the passages 27, 28 have the common section, the opening degree of the passages 27, 28 can be adjusted by a single valve body. In this case, a three-way control vale body is used.

Therefore, the present examples and embodiments are to be considered as illustrative and not restrictive and the invention is not to be limited to the details given herein, but may be modified within the scope and equivalence of the appended claims.

What is claimed is:

1. A control valve for changing the displacement of a compressor, comprising:

an accommodation cylinder;

a coil located about the accommodation cylinder;

a stator located in the accommodation cylinder;

a plunger located in the accommodation cylinder, wherein, when electric current is supplied to the coil, electromagnetic force is generated between the stator and the plunger and the plunger moves relative to the stator in the accommodation cylinder, accordingly; and a valve body coupled to the plunger, wherein, when the plunger moves, the valve body moves accordingly and adjusts the opening degree of a valve hole;

wherein a flat surface and a peripheral wall surrounding the flat surface are formed in an end of one of the plunger and the stator that faces the other one of the plunger and the stator, wherein the peripheral wall has a tapered cross-section with an inclined inner surface, and wherein the inclined inner surface and the flat surface define a recess;

wherein a frustum portion is formed in an end of the other one of the plunger and the stator that faces the recess, wherein the frustum portion includes a flat distal surface and an annular inclined surface; and wherein the taper angle of the peripheral wall is equal to or less than twenty degrees, and wherein the diameter of the flat distal surface of the frustum portion is equal to or greater than eighty percent of the largest diameter of the annular inclined surface.

2. The control valve according to claim 1, wherein the taper angle of the peripheral wall and the diameter of the flat distal surface of the frustum portion are determined based on the electromagnetic force generated by the coil and the rate of change of the electromagnetic force in relation to the opening degree of the valve hole.

3. The control valve according to claim 2, wherein the diameter of the flat surface of the recess is equal to the diameter of the flat distal surface of the frustum portion, and wherein the taper angle of the peripheral wall of the recess is equal to the angle defined by the annular inclined surface of the frustum portion and the inner wall of the accommodation cylinder.

4. The control valve according to claim 2, wherein the compressor forms a part of a refrigerant circuit of an air conditioner and includes:

a control chamber, wherein the compressor displacement is changed by adjusting the pressure in the control chamber;

a bleed passage connecting the control chamber to a suction pressure zone of the refrigerant circuit; and a supply passage connecting a discharge pressure zone of the refrigerant circuit to the control chamber;

wherein the valve hole of the control valve is located in the supply passage, and wherein the valve body adjusts the opening degree of the valve hole to adjust the pressure in the control chamber.

5. The control valve according to claim 4, further comprising a valve chamber for accommodating the valve body, wherein the valve chamber is connected to the discharge pressure zone by an upstream section of the supply passage, and wherein a valve opening force based on pressure in the refrigerant circuit acts against the electromagnetic force.

6. The control valve according to claim 4, further comprising a pressure sensing mechanism having a pressure sensing member, wherein the pressure sensing member detects the pressure at a pressure monitoring point located in the refrigerant circuit, wherein the pressure sensing member is displaced based on changes in the pressure at the pressure monitoring point to move the valve body such that the displacement of the compressor is changed to cancel the pressure changes; and wherein the electromagnetic force applied to the valve body is changed in accordance with the level of electric current supplied to the coil such that a target pressure, which is used as reference when the pressure sensing member determines the position of the valve body, is changed.

7. The control valve according to claim 6, wherein the pressure monitoring point is one of two pressure monitoring points located along the refrigerant circuit, and the pressure sensing member detects the pressure difference between the two pressure monitoring points and is displaced based on changes in the pressure difference between the pressure monitoring points, and wherein the target pressure is changed in accordance with the level of electric current supplied to the coil.

8. The control valve according to claim 7, wherein the pressure monitoring points are located in the discharge pressure zone of the refrigerant circuit.

9. The control valve according to claim 6, further comprising:

a valve body stopper for limiting the displacement of the valve body;

a spring for urging the valve body toward the valve body stopper, wherein the valve body is movably engaged with the pressure sensing member; and a pressure sensing member stopper for limiting the displacement of the pressure sensing member;

wherein the pressure sensing member has an elasticity and is urged toward the pressure sensing member stopper by its own elasticity, wherein, when the valve body stopper limits the displacement of the valve body and the pressure sensing member stopper limits the displacement of the pressure sensing member, a space exists between the valve body and the pressure sensing member, and wherein the electromagnetic force acts against the forces of the spring and the pressure sensing member.

10. A compressor used in a refrigerant circuit of an air conditioner comprising:

a control chamber, wherein the compressor displacement is changed by adjusting the pressure in the control chamber;

a bleed passage connecting the control chamber to a suction pressure zone of the refrigerant circuit;

a supply passage connecting a discharge pressure zone of the refrigerant circuit to the control chamber; and a control valve for changing the displacement of a compressor, wherein the control valve includes:

an accommodation cylinder;

a coil located about the accommodation cylinder;

a stator located in the accommodation cylinder;

a plunger located in the accommodation cylinder, wherein, when electric current is supplied to the coil, electromagnetic force is generated between the stator and the plunger and the plunger moves relative to the stator in the accommodation cylinder, accordingly; and a valve body coupled to the plunger, wherein, when the plunger moves, the valve body moves accordingly and adjusts the opening degree of a valve hole;

wherein a flat surface and a peripheral wall surrounding the flat surface are formed in an end of one of the plunger and the stator that faces the other one of the plunger and the stator, wherein the peripheral wall has a tapered cross-section with an inclined inner surface, and wherein the inclined inner surface and the flat surface define a recess;

wherein a frustum portion is formed in an end of the other one of the plunger and the stator that faces the recess, wherein the frustum portion includes a flat distal surface and an annular inclined surface; and wherein the taper angle of the peripheral wall is equal to or less than twenty degrees, and wherein the diameter of the flat distal surface of the frustum portion is equal to or greater than eighty percent of the largest diameter.

11. The compressor according to claim 10, wherein the taper angle of the peripheral wall and the diameter of the flat distal surface of the frustum portion are determined based on the electromagnetic force generated by the coil and the rate of change of the electromagnetic force in relation to the opening degree of the valve hole.

* * * * *

UNITED STATES PATENT AND TRADEMARK OFFICE

CERTIFICATE OF CORRECTION

PATENT NO. : 6,684,654 B2
DATED : February 3, 2004
INVENTOR(S) : Hiroshi Fukasaku et al.

It is certified that error appears in the above-identified patent and that said Letters Patent is hereby corrected as shown below:

Column 10,
Line 13, please delete "($\Delta Pd=0$)" and insert therefore -- ($\Delta Pd \neq 0$) --

Signed and Sealed this

Sixth Day of July, 2004

JON W. DUDAS
*Acting Director of the United States Patent and Trademark Office*